US008235612B2

(12) United States Patent
Jo et al.

(10) Patent No.: US 8,235,612 B2
(45) Date of Patent: Aug. 7, 2012

(54) PRINTING APPARATUS TO PREVENT MULTIFEED RELATED PRINTING ERRORS AND METHOD THEREOF

(75) Inventors: Gyeong-hun Jo, Suwon-si (KR); Geun-chul Lee, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1031 days.

(21) Appl. No.: 12/136,174

(22) Filed: Jun. 10, 2008

(65) Prior Publication Data

US 2009/0003848 A1 Jan. 1, 2009

(30) Foreign Application Priority Data

Jun. 27, 2007 (KR) ..... 10-2007-0063789

(51) Int. Cl.
*B65H 7/00* (2006.01)

(52) U.S. Cl. ..... 400/578; 271/258.03; 271/262; 271/263; 271/258.01

(58) Field of Classification Search ..... 400/708, 400/578; 271/258.01–258.03
See application file for complete search history.

(56) References Cited

U.S. PATENT DOCUMENTS

| | | | | |
|---|---|---|---|---|
| 6,481,705 | B1 * | 11/2002 | Okada | 271/4.03 |
| 6,978,997 | B2 * | 12/2005 | Able et al. | 271/258.01 |
| 7,740,241 | B2 * | 6/2010 | Itoh et al. | 271/262 |
| 2007/0081212 | A1 * | 4/2007 | Tonami et al. | 359/197 |

FOREIGN PATENT DOCUMENTS

| | | |
|---|---|---|
| JP | 3-14785 | 6/1991 |
| KR | 2004-66252 | 7/2004 |

* cited by examiner

*Primary Examiner* — Seung Lee
*Assistant Examiner* — Christle Marshall
(74) *Attorney, Agent, or Firm* — Stanzione & Kim, LLP

(57) ABSTRACT

A printing apparatus includes a multifeed sensor to detect whether printing paper sheets are multifed, a measuring unit to measure an interval between the multifed paper sheets, if the multifeed sensor detects that the printing paper sheets are multifed, and a control unit to delay printing using the measured interval so that a lastly fed printing paper sheet is printed. As a result, a printing error due to multifeed of two or more printing paper sheets can be avoided.

16 Claims, 6 Drawing Sheets

PRINTING APPARATUS TO PREVENT MULTIFEED RELATED PRINTING ERRORS AND METHOD THEREOF

CROSS-REFERENCE TO RELATED APPLICATIONS

This application claims priority under 35 U.S.C. §119 (a) from of Korean Patent Application No. 10-2007-0063789, filed on Jun. 27, 2007, in the Korean Intellectual Property Office, the disclosure of which is hereby incorporated herein in its entirety by reference.

BACKGROUND OF THE INVENTION

1. Field of the Invention

The present general inventive concept relates to a printing apparatus to prevent printing errors and method thereof, and more particularly, to a printing apparatus to prevent printing errors due to feeding of a recording medium such as paper sheets at a same time, and a method thereof.

2. Description of the Related Art

Printing apparatuses such as printers, copiers, facsimiles, or Multi Function Peripherals (MFP) form an image on a paper sheet using operations such as laser irradiation or ink firing. These printing apparatuses generally include a function of feeding printing paper sheets consecutively.

A printing apparatus separates a sheet of paper at a top of a paper stack placed in a cassette using a paper pickup means such as a pickup roller, and feeds the picked paper to a printing unit. Friction occurs between adjacent paper sheets as the paper sheet is picked up, and if friction is greater between a topmost paper sheet and the paper sheet or paper sheets below the topmost paper than between the topmost paper sheet and the paper pickup means, a paper sheet or paper sheets below the topmost paper are picked up together. This phenomenon will be called "multifeed" in the following description.

FIG. 1 illustrates an example of erroneous printing due to the multifeed problem. Referring to FIG. 1, an image is printed partially on each of a first, second and third printing sheets 10*a*, 10*b* and 10*c*. If this happens, a user needs to dispose of printouts, and reprint the image on new paper sheets. The multifeed also increases costs, as multifeed consumes printing consumables, such as ink, toner and paper sheets.

SUMMARY OF THE INVENTION

The present general inventive concept provides a printing apparatus to delay a next printing by a time interval to correspond to a distance between a paper sheet having been fed and a paper sheet yet to be fed, upon determining a multifeed of paper sheets wherein a plurality of printing paper sheets are fed in one paper pickup operation, and thus to increase user convenience, and a method thereof.

Additional aspects and utilities of the present general inventive concept will be set forth in part in the description which follows and, in part, will be obvious from the description, or may be learned by practice of the general inventive concept.

The foregoing and other aspects and utilities of the present general inventive concept may be achieved by providing a printing apparatus including a multifeed sensor to detect whether printing paper sheets are multifed, a measuring unit to measure an interval between the multifed paper sheets, if the multifeed sensor detects that the printing paper sheets are multifed, and a control unit to delay printing using the measured interval so that a lastly fed printing paper sheet is printed.

The multifeed sensor may detect that the printing paper sheets are multifed by detecting a thickness of the multifed printing paper sheets or detecting leading edges of the multifed printing paper sheets.

The printing apparatus may further include a printing unit to print on the printing paper sheets, and a storage unit to store information about the interval measured at the measuring unit, and wherein the control unit causes the printing unit to delay the printing corresponding to the stored interval, so that the printing paper sheet at a top of the multifed printing paper sheets is printed.

The measuring unit may measure a distance between leading edges of the multifed printing paper sheets. The control unit may delay the printing, if the measured distance is shorter than a distance between a sensing position of the multifeed sensor and a point of starting the printing.

The measuring unit may measure a time difference between feeding the leading edges of the multifed printing paper sheets. The control unit may delay the printing, if the time difference is shorter than a time difference between detecting of the multifeed sensor and the printing.

The multifeed sensor and the measuring unit may be integrated into one sensor.

The foregoing and other aspects and utilities of the present general inventive concept may also be achieved by providing a printing method of a printing apparatus, the method including detecting, through a sensor, whether printing paper sheets are multifed, measuring an interval between the multifed paper sheets, if the multifeed sensor detects that the printing paper sheets are multifed, and delaying printing using the measured interval so that a lastly fed printing paper sheet is printed.

The detecting may include detecting that the printing paper sheets are multifed by detecting a thickness of the multifed printing paper sheets or detecting leading edges of the multifed printing paper sheets. The delaying may include delaying the printing, if the measured distance is shorter than a distance between a sensing position of the multifeed sensor and a point of starting the printing.

The measuring may include measuring a time difference between feeding the leading edges of the multifed printing paper sheets. The delaying may include delaying the printing, if the time difference is shorter than a time difference between detecting through the sensor and the printing.

The foregoing and other aspects and utilities of the present general inventive concept may also be achieved by providing a printing method of a printing apparatus, the printing method including detecting, through a sensor, whether printing paper sheets are multifed, and delaying printing corresponding to an interval between multifed printing paper sheets.

The foregoing and/or other aspects and utilities of the general inventive concept may also be achieved by providing a printing apparatus including a measuring unit to measure an interval between recording medium sheets in a multifed state in response to a detection of the multifed state, and a control unit to delay printing an image on the respective multifed recording medium sheets corresponding to the measured interval, wherein the detection is based on one of detecting a thickness and leading edges of the respective multifed recording medium sheets.

The foregoing and/or other aspects and utilities of the general inventive concept may also be achieved by providing a printing method including measuring an interval between recording medium sheets in a multifed state in response to a detection of the multifed state based on one of a thickness and leading edges of the recording medium sheets, and delaying printing an image on one or more of the respective multifed recording medium sheets corresponding to the measured interval.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
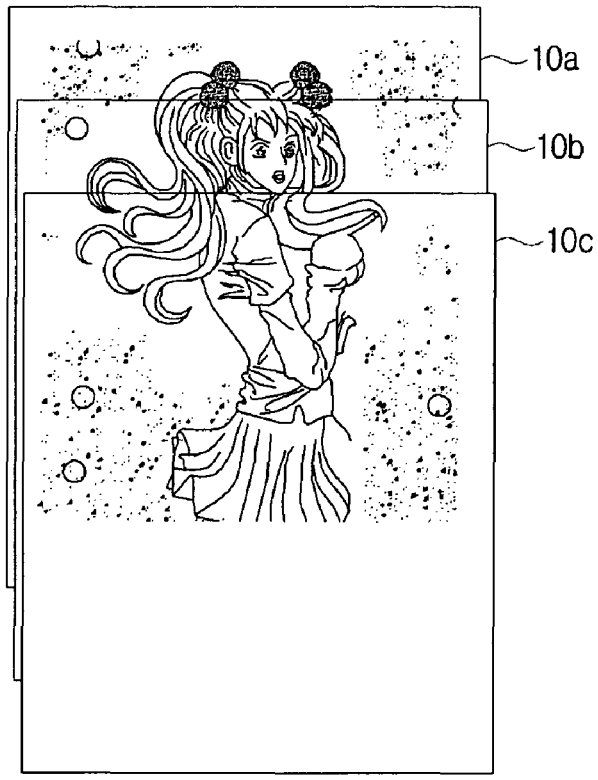
FIG. 1 (PRIOR ART)
FIG. 1 illustrates an example illustrating an erroneous printing due to multifeed of paper sheets in a conventional system.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
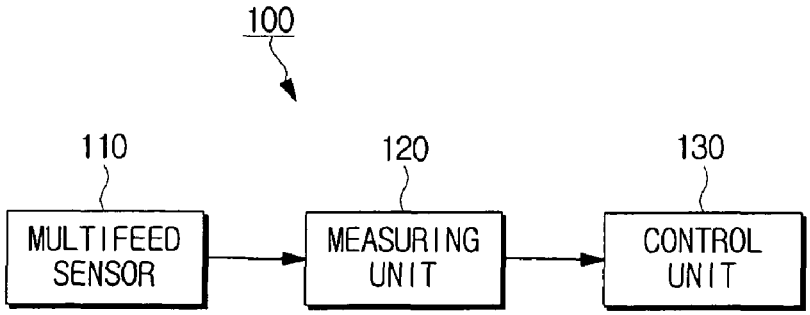
FIG. 2 is a block diagram illustrating a printing apparatus according to an example embodiment of the present general inventive concept.

FIG. 2 is a block diagram of a printing apparatus according to an example embodiment of the present general inventive concept.

Referring to FIG. 2, the printing apparatus 100 includes a multifeed sensor 110, a measuring unit 120, and a control unit 130.

The multifeed sensor 110 detects whether paper sheets are multifed. That is, the multifeed sensor 110 detects the thickness of a recording medium such as a printing paper sheet that has initially been fed, and determines that the paper sheets are multifed, if a variation in thickness is detected. In the alternative, the multifeed sensor 110 may determine that paper sheets are multifed, upon detecting the leading edge of a next printing paper sheet before an initially fed paper sheet exits the printing path. In the first example, the multifeed sensor 110 may recognize that the thickness of a printing paper sheet varies, upon determining that a resistance value of the printing paper sheet varies. In the alternative example, the multifeed sensor 110 may include a switch lever placed at a position on a paper conveyance path to contact the leading edge of a printing paper sheet to determine that paper sheets are being multifed, upon detecting contact with the leading edge of the next printing paper sheet.

The measuring unit 120 measures a distance between two or more consecutively fed paper sheets, upon detecting multifeed of the respective paper sheets through the multifeed sensor 110. In particular, the measuring unit 120 may measure a distance between a leading edge of a paper sheet having been initially fed and a leading edge of a paper sheet that follows the initially fed paper sheet. In the following description, the "distance between paper sheets" may refer to a temporal or spatial distance between leading edges of consecutively fed paper sheets.

Although the present embodiment employs the multifeed sensor 110 and the measuring unit 120 as separate elements, alternatively, a single integrated sensor may be employed to both detect the multifeed and to measure distance between leading edges of the printing paper sheets.

The control unit 130 causes a next printing to start at a predetermined delay that corresponds to the measured distance. Accordingly, an image is printed on a following printing paper sheet, after an interval that corresponds to the delay set by the control unit 130 based on the temporal or spatial inter-paper distance measured by the measuring unit 120. As a result, if printing paper sheets are multifed, the image is printed properly on a paper sheet which is fed after a delay set according to the measured distance between multifed paper sheets.

Figure 3:
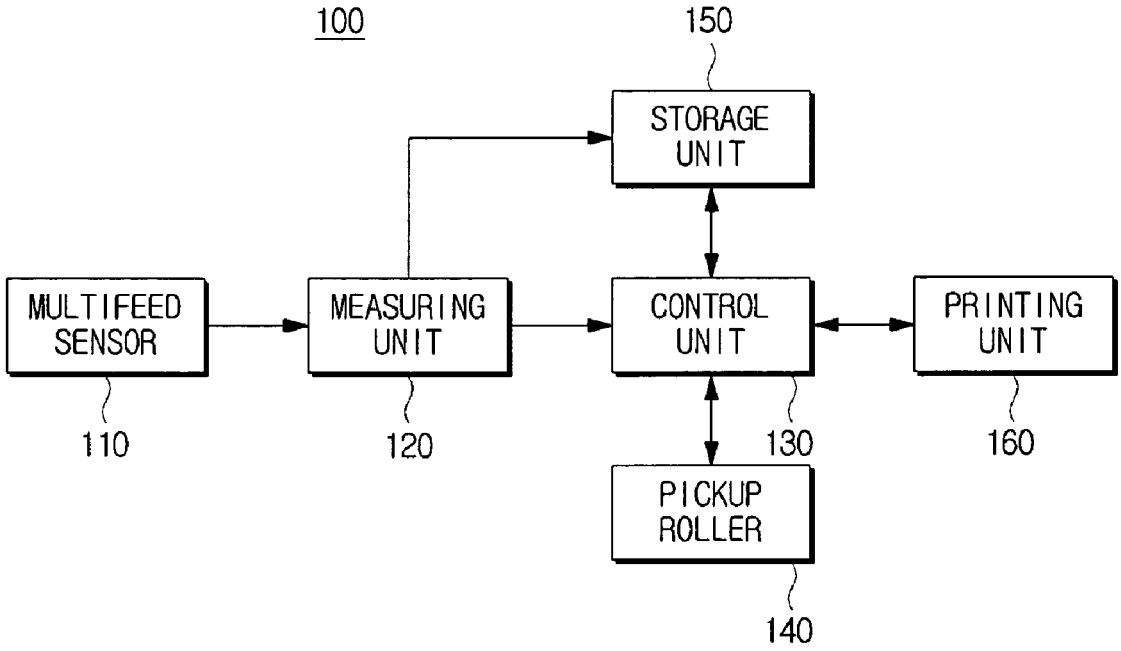
FIG. 3 is a detailed block diagram illustrating the printing apparatus of FIG. 2.

FIG. 3 is a detailed block diagram illustrating the printing apparatus of FIG. 2.

Referring to FIG. 3, the printing apparatus 100 includes a multifeed sensor 110, a measuring unit 120, a control unit 130, a pickup roller 140, a storage unit 150, and a printing unit 160.

The pickup roller 140 is placed at an upper end of a paper cassette (not illustrated) to rotate, and thus feed printing paper sheets in a rotating direction thereof.

The multifeed sensor 110 detects paper multifeeding, that is, detects whether paper sheets are fed at a same time. The multifeed sensor 110 may detect the paper multifeeding, by detecting a variation in the thickness of paper sheets that pass the sensing point, or by detecting the leading edge of the paper sheets.

The measuring unit 120 measures a distance between consecutively fed paper sheets, if the multifeed sensor 110 detects paper multifeeding. In particular, the measuring unit 120 may measure a distance between a leading edge of a paper sheet that has initially been fed to a leading edge of a next paper sheet that follows the initially fed paper sheet. In the following description, the "distance between paper sheets" may refer to temporal or spatial distance between leading edges of consecutively fed paper sheets.

The storage unit 150 stores information about the measured result by the measuring unit 120. In one example, the storage unit 150 may store a first distance between the initially fed paper sheet and the next first paper sheet, and store a second distance between the next first paper sheet and the next second paper sheet. If (n) number of paper sheets are multifed, the storage unit 150 may store distances between the paper sheets until the (n)th distance between the next (n−1)th paper sheet and the next (n)th paper sheet.

In an inkjet implementation, the print unit 160 may employ a header to fire ink. In this implementation, the measuring unit 120 may measure distances between each sheet of printing paper sheets.

If the multifeed sensor 110 detects multifeeding paper sheets, the control unit 130 controls the printing unit 160 to print with a delay according to the interval stored in the storage unit 150, and also to print on a paper sheet placed at the top. The "paper sheet placed at the top" refers to a paper sheet being positioned so as to directly face the ink firing face of the printing unit 160. For example, if leading edges of the initially-fed paper sheet and the following paper sheet are at a distance L1, the control unit 130 controls the printing unit 160 to start ejecting ink at a point of time when the initially-fed paper sheet passes the printing start point, that is, when the leading edge of the following paper sheet arrives at a position corresponding to the printing unit 160. That is, printing starts with a delay as much as L1, because the following paper sheet would be at the top of the two paper sheets and directly faces the ink ejecting face of the printing unit 160.

If a distance between the initially fed paper sheet and the following paper sheet is shorter than a distance between the sensing position of the multifeed sensor 110 and the printing start point (or ink firing point) of the printing unit 160, the control unit 130 may cause printing to start after a delay. If a distance between the initially fed paper sheet and the following paper sheet is longer than a distance between the sensing position of the multifeed sensor 110 and the printing start point of the printing unit 160, the control unit 130 may leave the initially fed paper sheet to be printed. This is because the printing apparatus 100 has already started printing, and thus delaying the printing start point is impossible. In the latter case, the printing apparatus 100 may notify a user of the printing error by multifeed in a variety of ways. For example, the printing apparatus 100 may notify the error through a display (not illustrated) provided therewith, or through a host apparatus (not illustrated) which has an input printing command.

In an implementation of laser printing, the printing unit 160 may include a scanning unit to perform printing with laser beam scanning. The measuring unit 120 may measure time differences of feeding the leading edges of each of the paper sheets.

Upon detecting multifeeding paper sheets through the multifeed sensor 110, the control unit 130 may control the printing unit 160 to form an image on a paper sheet at the top of the multifed paper sheets after delaying the printing operation corresponding to, for example, the interval stored in the storage unit 150. For example, if a second paper sheet is fed at the time interval of T1, the control unit 130 may control the printing unit 160 to scan a laser beam at the point of time when the initially fed paper sheet has moved through the printing unit 160 by the interval of T1 and when the leading edge of the second paper sheet reaches the printing unit 160.

The control unit 130 may cause a printing operation to start after a delay, if a time difference between the feeding of the initially fed paper sheet and the secondly fed paper sheet is shorter than a time difference between the sensing point of the multifeed sensor 110 and the starting of the printing operation. If the time difference between the feeding of paper sheets is longer than the time difference between the sensing point and the printing operation, delaying the printing is difficult. Accordingly, the control unit 130 discharges the initially fed paper sheets among the paper sheets. In this case, the printing apparatus 100 may notify a user of a multifeed error, and the user may avoid the printing error due to multifeed, by properly dealing with the problem such as delaying the printing operation.

Figure 4:
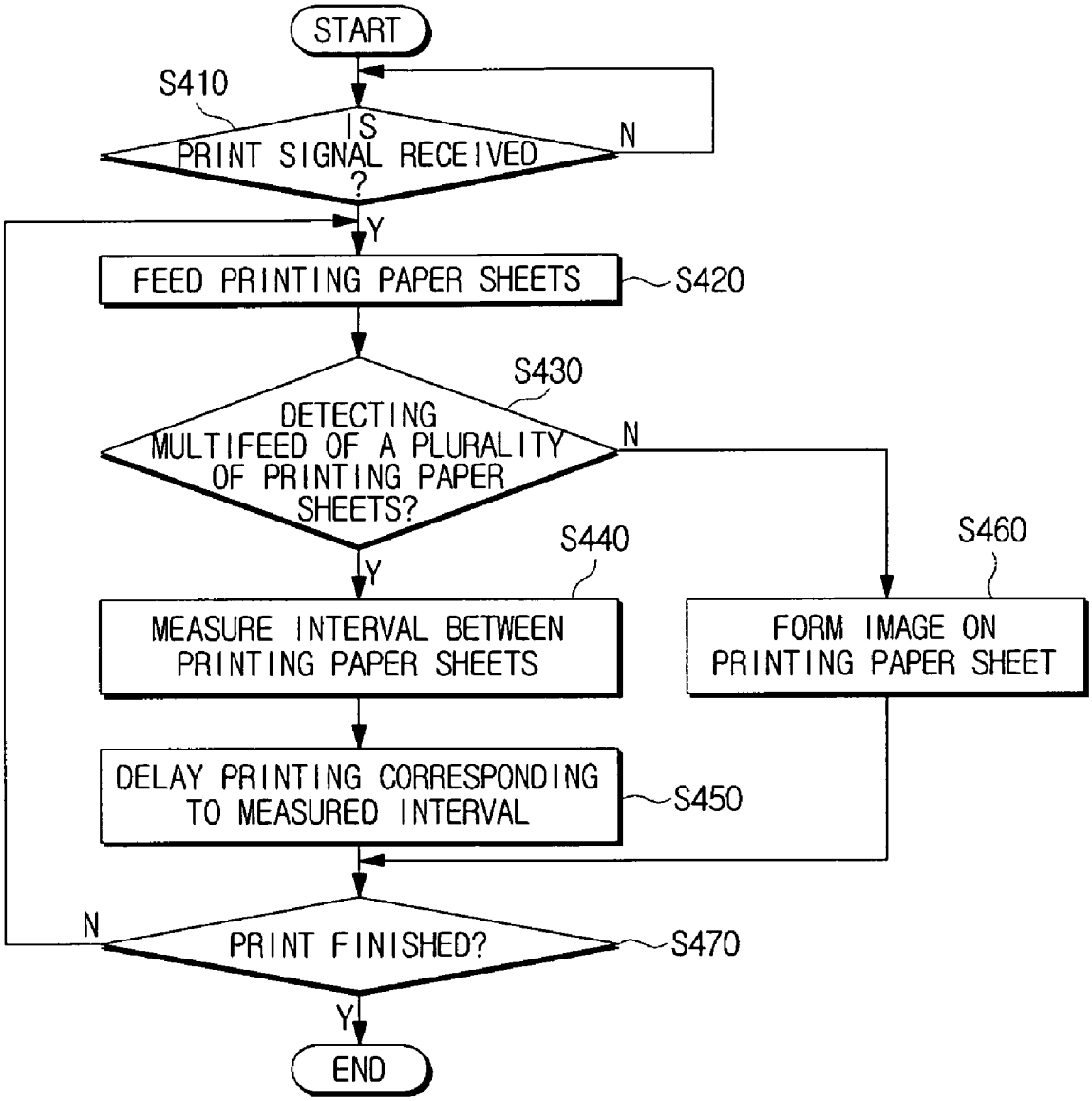
FIG. 4 is a flowchart illustrating a printing method of a printing apparatus according to an example embodiment of the present general inventive concept.

FIG. 4 is a flowchart illustrating a printing method of a printing apparatus according to an example embodiment of the present general inventive concept.

Referring to FIGS. 3 and 4, the printing apparatus 100 receives a print signal at operation S410. Accordingly, the printing apparatus 100 feeds printing paper sheets at operation S420. The paper sheets are fed by a rotation of the pickup roller, and in a direction of the rotation of the pickup roller.

Upon detecting multifeed of paper sheets through a sensor at operation S430, the printing apparatus 100 measures an interval between the multifed paper sheets at operation S440. That is, the printing apparatus 100 detects a variation of a thickness of the respective paper sheet, upon detecting a leading edge of an initially fed paper sheet through the sensor. Based on the detected variation of the thickness of the paper sheet, the printing apparatus 100 determines that the paper sheets are multifed. If the printing apparatus 100 detects a leading edge of the initially fed paper sheet, the printing apparatus measures a distance between the sensing point and detecting of the secondly fed paper sheet, or a time difference between the feeding of the respective paper sheets.

At operation S450, the printing apparatus 100 delays the printing operation based on the measured result. That is, the printing apparatus 100 delays the printing operation to start with a delay that corresponds to the measured distance or time difference, before the printing apparatus forms an image on the secondly fed paper sheet.

The printing apparatus at operation S460 forms an image on the initially fed paper sheet, if multifeed of paper sheets is not detected through the sensor at operation S430.

If printing job is not finished at operation S470 after operations at S450 and S460, the printing apparatus reiterates operations S420 to S460 until a given job is completed. Throughout the printing operation, errors due to multifeed of paper sheets are prevented.

Figure 5:
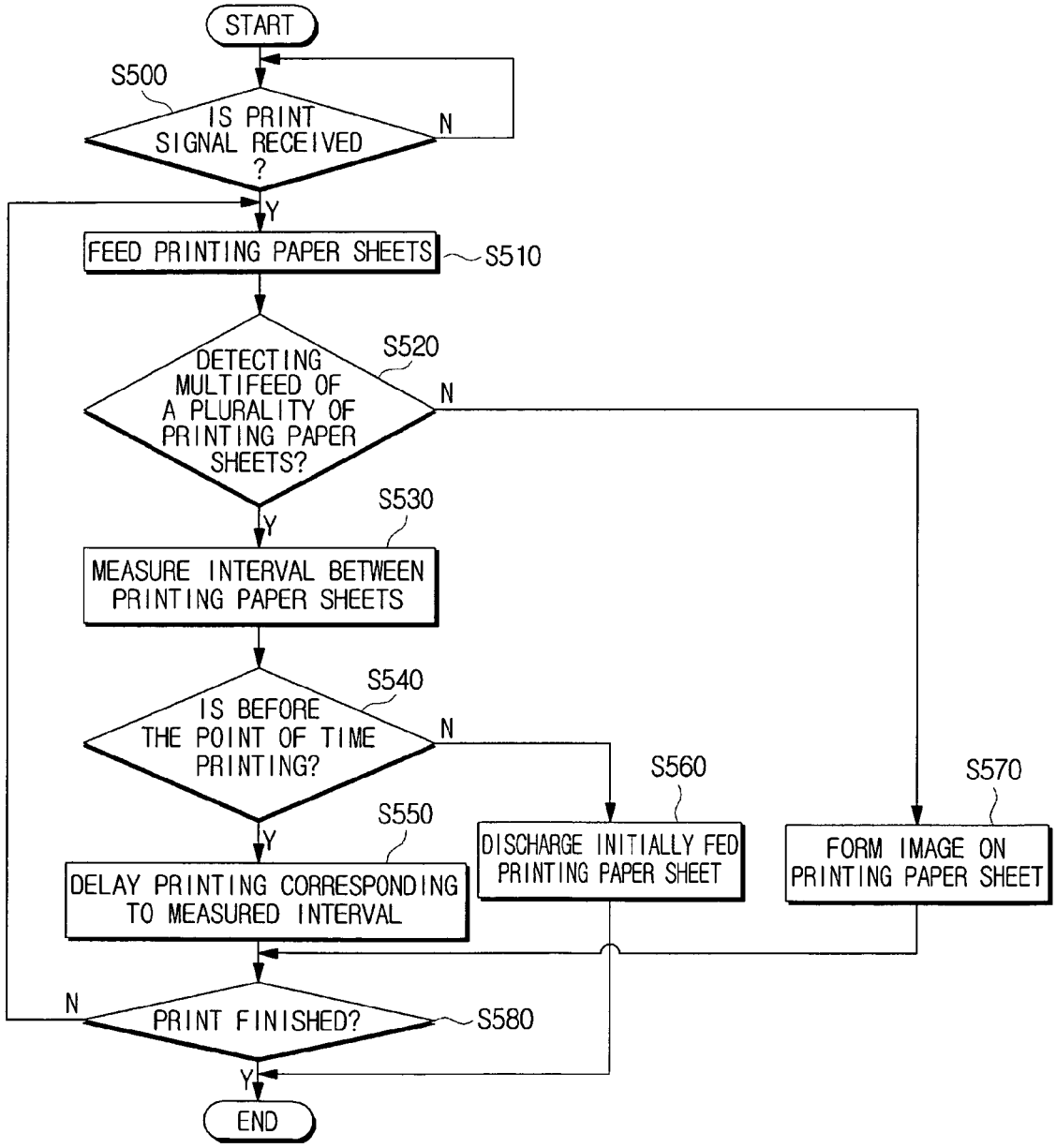
FIG. 5 is a flowchart further illustrating the printing method of FIG. 4.

FIG. 5 is a flowchart further illustrating the printing method of FIG. 4.

Referring to FIGS. 3 and 5, the printing apparatus 100 receives a print signal at operation S500, and starts feeding paper sheets at operation S510.

At operation S520, if the printing apparatus 100 detects multifeed of paper sheets through a sensor, the printing operation at operation S530 measures an interval between the paper sheets. For example, the printing apparatus 100 may measure a distance between edges of the multifed paper sheets, or measure a time difference between the feeding of leading edges of the respective paper sheets. The measured result may be stored in a storing medium.

At operation S540, the printing apparatus 100 determines whether the point of time of measuring the interval between the paper sheets precedes the printing operation. For example, in an implementation of an inkjet printing apparatus, the printing apparatus 100 determines that the point of time is before the printing operation, if the distance between the initially fed paper sheet and the following paper sheet is shorter than a distance from the sensing position of the multifeed sensor 110 to the printing start position of the printing unit 160. In an implementation of a laser printing apparatus, the printing apparatus 100 determines that the point of time is before the printing operation, if time difference between leading edges of the initially fed paper sheet and the following paper sheet is shorter than time difference between the sensing of the multifeed sensor 110 and the starting of printing, that is, laser beam scanning of the printing unit 160.

At operation S550, upon determining that the point of time is before the printing operation, the printing apparatus 100 delays the time of starting printing based on the measured interval. That is, the printing apparatus 100 delays the starting of printing operation corresponding to, for example, the distance between leading edges of the initially fed paper sheet and the following paper sheet. Alternatively, the printing apparatus 100 may delay the starting of the printing operation corresponding to, for example, the time difference between the feeding of leading edges of the initially fed paper sheet and the following paper sheet. Later as the printing is started, a desired image is formed on a paper sheet at the top of the multifed paper sheets that directly faces the printing unit 160.

However, if the printing has already begun, the printing apparatus 100 discharges the initially fed paper sheet at operation S560. The printing apparatus 100 may notify a user of a printing error due to multifeed.

At operation S570, the printing apparatus may form a desired image on the initially fed paper sheet if no multifeed is detected at operation S520.

If the printing is not finished at operation S580 after the operations S550 to S570, the printing apparatus 100 reiterates operations S510 to S570 until a given job is completed. During the printing, printing error due to multifeed is prevented.

Figure 6A:
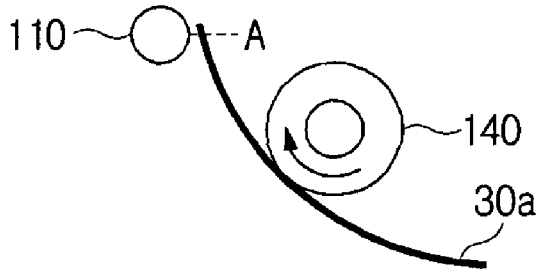
FIGS. 6A to 6C illustrate a detecting operation of a multifeed sensor according to an example embodiment of the present general inventive concept.
Figure 6B:
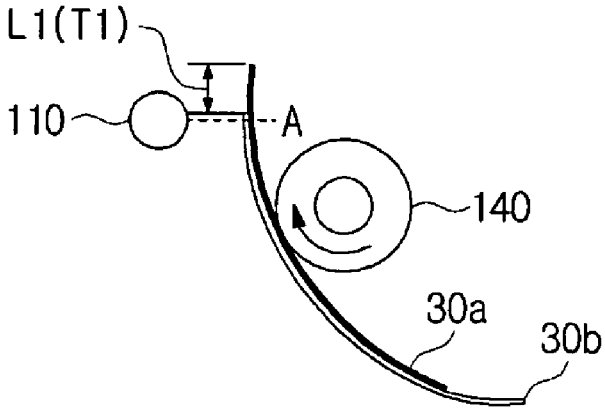
Figure 6C:
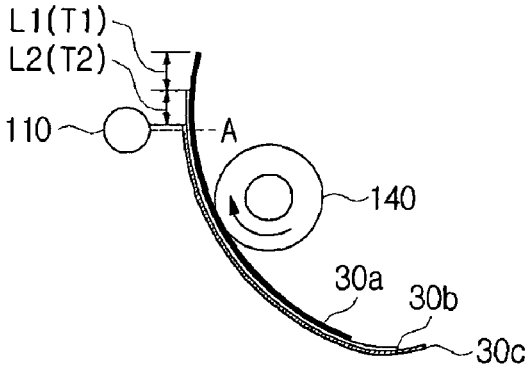

FIGS. 6A to 6C illustrate a detecting operation of a multifeed sensor according to an example embodiment of the present general inventive concept.

Referring to FIG. 6A, when a print signal is received, the pickup roller 140 rotates, to feed the first paper sheet 30*a* in a direction illustrated by the arrow. As a leading edge of the first paper sheet 30*a* reaches point A, which is the sensing position of the multifeed sensor 110, the multifeed sensor 110 detects the first paper sheet 30*a*.

Referring to FIG. 6B, if leading edge of the second paper sheet 30*b* reaches point A, before the first paper sheet 30*a* completely passes the multifeed sensor 110, the multifeed sensor 110 perceives multifeed of paper sheets based on a variation in a thickness of paper sheets. According to the detection of the multifeed sensor 110, an interval is measured between the leading edge of the first paper sheet 30*a* and the leading edge of the second paper sheet 30*b*. A distance between the first and second paper sheets 30*a* and 30*b*, or a time difference between detecting the first and second paper sheets 30*a* and 30*b*, may be the measured interval.

FIG. 6B illustrates the first and second paper sheets 30*a* and 30*b* at distance L1. The distance L1 is stored in the storage unit 150. As L1 is detected, a printing operation starts after a delay that corresponds to L1. For example, if L1 is 3 cm, the printing unit 160 starts printing at a point of time that the first paper sheet 30*a* passes as much as 3 cm. As a result, image is formed on the second paper sheet 30*b* which is multifed at an interval of 3 cm from leading edge of the first paper sheet 30*a*.

FIG. 6C illustrates multifed paper sheets. In the case of FIG. 6C, images are printed according to measured intervals between each of the multifed paper sheets. For example, if interval L1 is measured between the first and second paper sheets 30*a* and 30*b*, printing is delayed as much as L1. If interval L2 is measured between the second and third paper sheets 30*b* and 30*c*, printing is delayed as much as L2. In other words, upon determining that the first to third paper sheets 30*a*, 30*b* and 30*c* is multifed, printing is delayed corresponding to, for example, a total measured intervals, that is, L1+L2.

Figure 7:
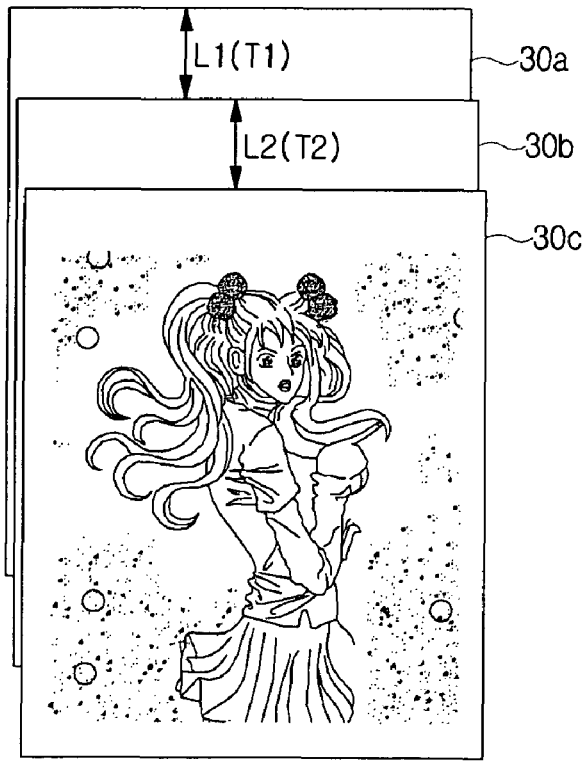
FIG. 7 illustrates a printing image according to an example embodiment of the present general inventive concept.

FIG. 7 illustrates an image printed on the third paper sheet 30*c* at a top of the multifed paper sheets 30*a*, 30*b* and 30*c*, as a result of printing delay by L1+L2.

Referring to FIGS. 6A to 6C, and FIG. 7, a distance between paper sheets was employed as an example. However, this should not be understood as limiting. Alternatively, printing may be delayed using time differences T1 and T2 of feeding paper sheets. According to the example embodiments, the first and second paper sheets 30*a* and 30*b* are discharged unprinted, and thus reusing the paper sheets is possible.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

According to various embodiments explained above, user convenience is improved because a printing error due to multifeed is prevented, by changing a location to print from a current paper sheet to a leading edge of a following paper sheet, upon detecting multifeed.

Use of consumables is also reduced, and cost is saved, because errors due to multifeed of paper sheets are prevented.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A printing apparatus, comprising:

an integrated sensor including a multifeed sensor to detect whether printing paper sheets are multifed and the integrated sensor including a measuring unit to measure an interval between the leading edges of the multifed paper sheets, if the multifeed sensor detects that the printing paper sheets are multifed; and a control unit to delay printing using the measured interval so that a lastly fed printing paper sheet is printed.

2. The printing apparatus of claim 1, wherein the multifeed sensor detects that the printing paper sheets are multifed by detecting a thickness of the multifed printing paper sheets or detecting leading edges of the multifed printing paper sheets.

3. The printing apparatus of claim 1, further comprising:

a printing unit to print on the printing paper sheets; and a storage unit to store information about the interval measured at the measuring unit, and wherein the control unit causes the printing unit to delay the printing corresponding to the stored interval, so that the printing paper sheet at a top of the multifed printing paper sheets is printed.

4. The printing apparatus of claim 3, wherein the measuring unit measures a distance between leading edges of the multifed printing paper sheets.

5. The printing apparatus of claim 4, wherein the control unit delays the printing, if the measured distance is shorter than a distance between a sensing position of the multifeed sensor and a point of starting the printing.

6. The printing apparatus of claim 3, wherein the measuring unit measures a time difference between feeding the leading edges of the multifed printing paper sheets.

7. The printing apparatus of claim 6, wherein the control unit delays the printing, if the time difference is shorter than a time difference between detecting of the multifeed sensor and the printing.

8. A printing method of a printing apparatus, the method comprising:

detecting, through a sensor, whether printing paper sheets are multifed and measuring, through the sensor, an interval between the leading edges of the multifed paper sheets, if the sensor detects that the printing paper sheets are multifed; and delaying printing using the measured interval so that a lastly fed printing paper sheet is printed.

9. The printing method of claim 8, wherein the detecting comprises:

detecting that the printing paper sheets are multifed by detecting a thickness of the multifed printing paper sheets or detecting leading edges of the multifed printing paper sheets.

10. The printing method of claim 8, wherein the measuring comprises:

measuring a distance between leading edges of the multifed printing paper sheets.

11. The printing apparatus of claim 10, wherein the delaying comprises:

delaying the printing, if the measured distance is shorter than a distance between a sensing position of the multifeed sensor and a point of starting the printing.

12. The printing method of claim 8, wherein the measuring comprises:

measuring a time difference between feeding the leading edges of the multifed printing paper sheets.

13. The printing method of claim 12, wherein the delaying comprises:

delaying the printing, if the time difference is shorter than a time difference between detecting through the sensor and the printing.

14. A printing method of a printing apparatus, the printing method comprising:

detecting, through a sensor, whether printing paper sheets are multifed; and delaying printing corresponding to an interval between leading edges of the multifed printing paper sheets, the interval being measured by a measuring unit integrated within the sensor.

15. A printing apparatus, comprising:

a sensor including a multifeed sensor to detect whether printing paper sheets are in a multifed state and a measuring unit integrated within the sensor to measure an interval between leading edges of the recording medium sheets in the multifed state in response to a detection of the multifed state; and a control unit to delay printing an image on the respective multifed recording medium sheets corresponding to the measured interval, wherein the detection is based on one of detecting a thickness and leading edges of the respective multifed recording medium sheets.

16. A printing method, comprising:

detecting, in a sensor, whether printing paper sheets are in a multifed state and measuring, in the sensor, an interval between leading edges of the recording medium sheets in a multifed state in response to a detection of the multifed state based on one of a thickness and leading edges of the recording medium sheets; and delaying printing an image on one or more of the respective multifed recording medium sheets corresponding to the measured interval.

* * * * *